US009421547B2

(12) United States Patent
Boast et al.

(10) Patent No.: US 9,421,547 B2
(45) Date of Patent: Aug. 23, 2016

(54) JAW CRUSHER

(71) Applicant: Terex GB Limited, Leicestershire (GB)

(72) Inventors: Ian Boast, Leicestershire (GB); Bryn Winkworth, Leicestershire (GB); Mark Houston, Leicestershire (GB)

(73) Assignee: Terex GB Limited, Leicestershire (GB)

( * ) Notice: Subject to any disclaimer, the term of this patent is extended or adjusted under 35 U.S.C. 154(b) by 432 days.

(21) Appl. No.: 13/906,986

(22) Filed: May 31, 2013

(65) Prior Publication Data

US 2013/0320123 A1 Dec. 5, 2013

(51) Int. Cl.

| | |
|---|---|
| ***B02C 1/02*** | (2006.01) |
| ***B02C 1/04*** | (2006.01) |
| *B02C 1/00* | (2006.01) |

(52) U.S. Cl.

CPC ..... *B02C 1/025* (2013.01); *B02C 1/04* (2013.01); *B02C 1/00* (2013.01)

(58) Field of Classification Search

CPC ..... B02C 1/02; B02C 1/025; B02C 1/06
USPC ..... 241/264, 266, 268
See application file for complete search history.

(56) References Cited

U.S. PATENT DOCUMENTS

| | | | | |
|---|---|---|---|---|
| 3,166,259 A | | 1/1965 | Curtis | |
| 3,318,540 A | | 5/1967 | Gilbert | |
| 3,473,744 A | | 10/1969 | Dediemar | |
| 4,165,044 A | | 8/1979 | Batch | |
| 4,637,562 A | * | 1/1987 | Hagiwara | B02C 1/10 241/259.2 |
| 4,783,013 A | * | 11/1988 | Polzin | B02C 1/025 241/219 |
| 5,110,057 A | * | 5/1992 | Karra | B02C 1/02 241/266 |
| 5,799,888 A | * | 9/1998 | Hamaguchi | B02C 1/025 241/259.1 |
| 6,375,105 B1 | * | 4/2002 | Haven | B02C 1/025 241/264 |
| 7,614,573 B1 | | 11/2009 | Jean | |
| 2002/0036246 A1 | * | 3/2002 | Togashi | B02C 1/04 241/101.74 |
| 2005/0116076 A1 | * | 6/2005 | Went | B02C 1/005 241/291 |
| 2014/0239101 A1 | * | 8/2014 | Eriksson | B02C 1/025 241/27 |

FOREIGN PATENT DOCUMENTS

| | | |
|---|---|---|
| EP | 1190772 A1 | 3/2002 |
| GB | 2387342 A | 10/2003 |
| JP | 06-182239 A | 5/1994 |

OTHER PUBLICATIONS

Search Report under Section 17(5) issued Oct. 1, 2012 in corresponding GB application No. 1209787.9 (4 pages).

* cited by examiner

*Primary Examiner* — Faye Francis
(74) *Attorney, Agent, or Firm* — Osha • Liang LLP

(57) ABSTRACT

A jaw crusher having a fixed jaw and a swing jaw disposed between opposing side walls of the jaw crusher. The swing jaw is movable relative to the fixed jaw for generating impelling forces to crush material present between the two jaws. The jaw crusher includes a cross beam which extends between the opposing side walls and a toggle plate is provided between a rear face of the swing jaw and the cross beam. Pressure cylinders are provided for applying a load to the cross beam, to provide a reaction to forces generated during movement of the swing jaw. The jaw crusher comprises a locking arrangement for selectively preventing substantial movement of the cross beam against the action of the pressure cylinders.

19 Claims, 2 Drawing Sheets

JAW CRUSHER

TECHNICAL FIELD

The present invention relates to a jaw crusher, more particularly, but not exclusively, to a jaw crusher for crushing rock material.

BACKGROUND OF THE INVENTION

Quarried material is often processed by means of crushing plant, for the production of aggregate, for example. There are various known forms of crushing plant for the comminution of rock material and the like, one of which is referred to as a jaw crusher.

GB2387342 describes a known jaw crusher of the kind having a fixed jaw and a swing jaw disposed between opposing side walls of the jaw crusher, wherein the swing jaw is movable relative to the fixed jaw, for generating impelling forces to crush material present in a crushing chamber defined by between the two jaws. The jaw crusher includes a cross beam which extends through apertures in the opposing side walls, and a toggle plate is provided between a rear face of the swing jaw and the cross beam. An hydraulic cylinder is mounted in each of said side wall apertures, for applying a load to cross beam, which is transmitted to the swing jaw via the toggle plate.

A shim pack consisting of a plurality of removable shim plates is provided in each side wall aperture, between the front face of the cross beam and an end surface of the respective aperture, for setting and adjusting the normal working clearance between the lower end of the swing jaw and the fixed jaw.

Crushing forces generated during movement of the swing jaw are passed through the toggle plate against the cross beam and back to the hydraulic cylinders. However, the hydraulic cylinders are pre-pressurized to a predetermined value, for example 400 bar, against an end surface of the respective side wall apertures, through the cross beam and the shim pack, and thereby provide a pre-loaded reaction to the forces generated during movement of the swing jaw.

This provides a substantially compact design of jaw crusher, which has particular advantage for use as mobile plant.

If pressure generated during the crushing cycle becomes excessive, for example in an overload situation where an uncrushable object is present in the crushing chamber, the load applied to the cross beam via the toggle plate will exceed the pre-load pressure of the hydraulic cylinders. To address this, a relief valve is provided in an hydraulic circuit to the cylinders. This allows fluid under pressure to be released from the hydraulic cylinders, allowing the respective cylinder piston to be pushed backwards, to enable the swing jaw to move away from the fixed jaw and thereby to allow the crushing chamber to be cleared safely.

In order to adjust the spacing between the lower ends of the jaws, it is first necessary to release the pressure from the cylinder arrangements, to enable the pistons to retract. This relieves the load on the cross beam and allows safe removal of the shim packs.

The present invention provides a more adaptable jaw crusher arrangement.

SUMMARY OF THE INVENTION

According to the present invention there is provided a jaw crusher having a fixed jaw and a swing jaw disposed between opposing side walls of the jaw crusher, wherein the swing jaw is movable relative to the fixed jaw for generating impelling forces to crush material present between the two jaws. The jaw crusher includes a cross beam which extends between the opposing side walls, and a toggle plate is provided between a rear face of the swing jaw and the cross beam. Pressure cylinders (e.g. hydraulic cylinders) are provided for applying a load to the cross beam, to provide a reaction to forces generated during movement of the swing jaw. The jaw crusher further comprises a locking arrangement for selectively preventing substantial movement of the cross beam against the action of the hydraulic cylinders.

This novel arrangement provides a more adaptable jaw crusher, insofar as the locking arrangement gives the operator the option to maintain a pre-load in the cylinders even in the event of high crushing pressures. In GB2387342, the cylinder pressure is reduced, in order to relieve the excess load from the crushing chamber. This functionality may still be provided in a jaw crusher according to the above aspect of the invention. However, the locking arrangement allows the jaw crusher to be used to crush difficult materials without using a pressure relief arrangement.

In exemplary embodiments, the locking arrangement includes a locking member which is movable between a first position where crushing loads are transmitted from the crossbeam to the hydraulic cylinders and a second position where crushing loads are carried by the side walls of the jaw crusher.

The locking member may take the form of a mechanical spacer for locking the cross beam against rearward movement in the event of excess loads being generated during movement of the swing jaw.

In exemplary embodiments, the cross beam extends through apertures in the opposing side walls. Each aperture may include a first end stop against which a first face of the cross beam is to be driven by the hydraulic cylinders.

In exemplary embodiments, an hydraulic cylinder is mounted in each of said apertures for urging the cross beam in a first direction, e.g. against the first end stops. The action of the cylinders may be in line with the side walls.

In exemplary embodiments, each hydraulic cylinder includes a cylinder body and a piston which is movable relative to the cylinder body. The cylinder body may be mounted within a respective side wall aperture against a second end stop.

The locking arrangement may comprise a mechanical spacer to be positioned between a rear face of the cross beam and the cylinder body. In these embodiments, the spacer is configured for preventing substantial movement of the cross beam in the direction of said cylinder body. The result is that excess loads from the crushing chamber are transmitted from the cross beam to the side walls via the spacers, cylinder bodies and second end stops.

In exemplary embodiments, the spacer is configured to form a sleeve for at least a portion of the circumference of the piston. The sleeve may be substantially U-shaped. The sleeve may comprise at least one handle by which the sleeve can be manipulated.

The locking arrangement may be manually operable.

In exemplary embodiments, the jaw crusher further comprises an adjustment mechanism for the adjusting spacing between the jaws. The adjustment mechanism may be mounted in operative communication between the cross beam and the toggle plate, such that load is transmitted to the toggle plate via the adjustment mechanism during the application of load on the cross beam from the hydraulic cylinders.

The adjustment mechanism may comprise two wedges slidable with respect to one another for increasing or decreasing the jaw spacing. The adjustment mechanism may comprise at least one actuator configured to slide at least one of said wedges to increase or decrease the jaw spacing.

The adjustment mechanism is operable without the need to move the cross beam in a rearward direction and without needing to relieve the pressure applied through the cylinders.

BRIEF DESCRIPTION OF THE DRAWINGS

Other aspects and features of the invention will be apparent from the claims and following description of embodiments, made by way of example, with reference to the following drawings, in which:

DETAILED DESCRIPTION OF PREFERRED EMBODIMENTS

Figure 1:
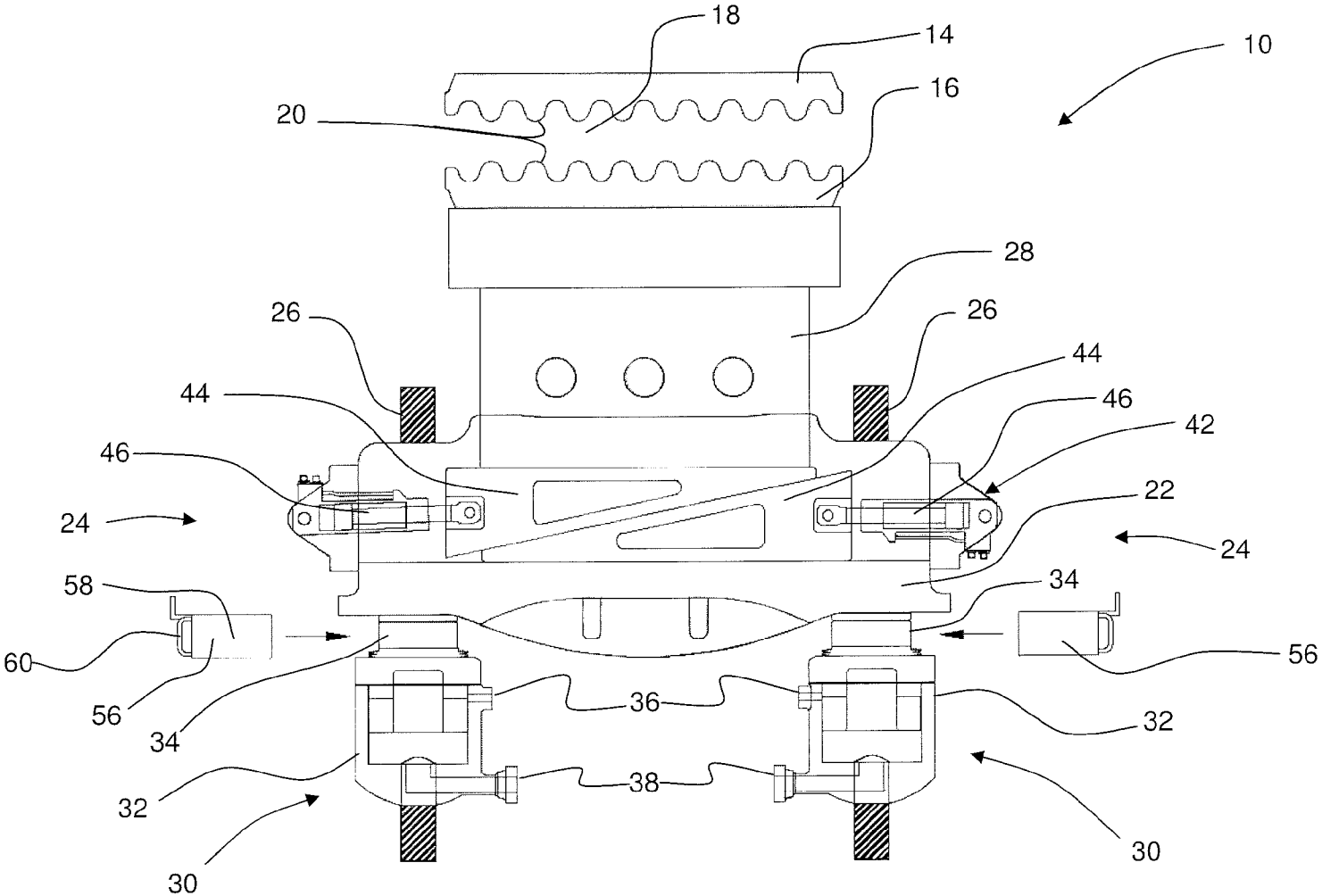
FIG. 1 is a partially cross-sectional view through a jaw crusher in a first, unlocked state.
Figure 2:
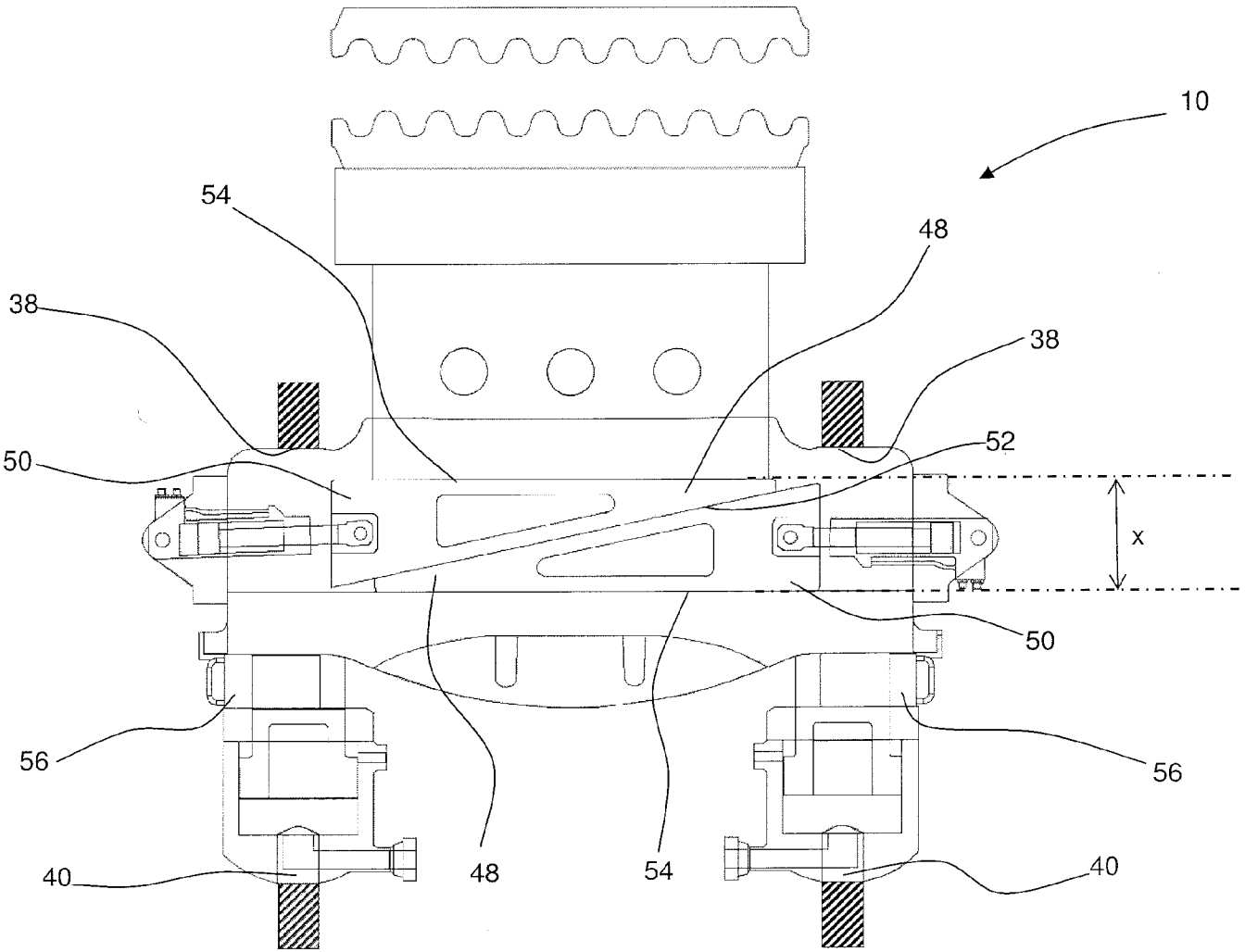
FIG. 2 is a partially cross-sectional view through the jaw crusher of FIG. 1 in a second, locked state.

With reference to FIGS. 1 and 2, a jaw crusher assembly is generally indicated at 10. The jaw crusher assembly 10 includes a pair of jaws; a fixed jaw 14 and a swing jaw 16. The jaws 14, 16 are of conventional construction and are each provided with a wear surface 20. The wear surfaces 20 each define a crushing face on a respective jaw 14, 16, and the two crushing faces define a crushing chamber 18 for receiving material to be crushed.

An upper end of the swing jaw 16 is connected to the jaw crusher assembly in a known manner by a shaft (not shown) rotatably received in a bearing (not shown). Rotation of the shaft causes circular motion of the upper end of the swing jaw 16 in the direction of the fixed jaw 14. The mounting and movement of the upper end of the swing jaw 16 on the jaw crusher assembly 10 is wholly conventional and shall not be described in any further detail.

The jaw crusher assembly 10 includes a cross beam 22. The cross beam 22 extends across a transverse axis of the jaw crusher assembly 10. The ends of the cross beam 22 are received in elongate apertures (indicated generally at 24) in opposing walls 26 of the jaw crusher frame, e.g. in a manner generally as shown in GB2387342.

A toggle plate 28 is provided between the rear face of the swing jaw 16 and the cross beam 22 and is supported by toggle seats (not shown) at either end, e.g. in a manner generally as shown in GB2387342.

An hydraulic cylinder arrangement consisting, in this embodiment, of a pair of hydraulic cylinders 30, in parallel, is provided for operative engagement with the rear face of the cross beam 22. The hydraulic cylinders 30 are each received in a respective side wall aperture 24. Hence, the action of the cylinders 30 is in line with the side walls 26.

Each hydraulic cylinder 30 has a cylinder body 32 and a piston 34 operatively reciprocable within the cylinder body 32. The cylinder body 32 has relief and supply lines connected to an hydraulic fluid circuit (not shown) via ports 36, 38 e.g. in a manner generally as described in GB2387342. The fluid circuit may include a relief circuit to enable the pressure in the cylinders to be relieved, e.g. in overload situations or if an uncrushable blockage is present between the jaws 14, 16.

An adjustment mechanism 42 is provided between the front of the cross beam 22 and the toggle plate 28. The adjustment mechanism is configured for setting or adjusting the spacing between the lower ends of the jaws 14, 16 so that a predetermined maximum product size may be produced during the crush cycle.

In this embodiment the adjustment mechanism takes the form of a pair of wedges 44 configured to be moved in relation to one another by actuators 46, as described in more detail below. In this embodiment, the actuators 46 are hydraulic cylinders arranged for sliding the wedges 44 in and out in a transverse axis of the jaw crusher.

Each wedge 44 has a narrow end 48 and a wide end 50 separated by an inclined surface 52. The wedges 44 are arranged alongside one another so that the narrow end 48 of one wedge 44 is proximal the wide end 50 of the other wedge 44, and vice versa, so that together the wedges 44 define two parallel edges 54 that are also parallel to the front of the cross beam 22. The parallel edges 54 are distance x (shown on FIG. 2) apart—this is the distance between the cross beam 22 and the toggle plate 28, which is adjustable as described below.

The wedges 44 can be moved in relation to one another by the hydraulic cylinders to increase or decrease the distance x. The hydraulic cylinders 46 are connected to the wide end 50 of each wedge 44. The hydraulic cylinders 46 are configured to move the wedges 44 towards and away from one another to increase or decrease distance x. Increasing the distance x moves the toggle plate 28 and thus the swing jaw 16 towards the fixed jaw 14, and so decreases spacing between the jaws 14, 16. Similarly, decreasing the distance x will increase the spacing between the jaws 14, 16.

In use, rotation of the shaft causes cyclic movement of the swing jaw 16 between a first position, in which the crushing face of the swing jaw 16 is inclined to the crushing face of the fixed jaw 14, and a second position in which the crushing face of the swing jaw 16 is brought substantially parallel to the crushing face of the fixed jaw 14, at a predetermined spacing from one another. Hence, in use, the crushing face of the swing jaw 16 moves in a crushing cycle, up and down, as well as towards and away from the crushing face of the fixed jaw 14. Material to be crushed is introduced into the crushing chamber 18 through the top of the jaw crusher assembly 10 and crushed material is discharged through the spacing between the lower end of the two jaws 14, 16. The cyclic movement of the swing jaw 16, as described above, causes impelling forces for crushing the material present in the crushing chamber 18.

In use, the hydraulic cylinders 30 are pressurised to a predetermined value, for example 400 bar. Accordingly, the cross beam 22 is forced under the action of the cylinders 30 against a stop, which in this embodiment is defined by an end surface 38 of the apertures 24. Each cylinder body 32 is mounted within a respective side wall aperture 24 and acts against a further stop, in this embodiment formed by an end surface 40 and the opposite end of the aperture 24 to the end surface 38, when the respective piston 34 is extended and in use to drive the cross beam against the first end stop 38.

Hence, a pre-load is applied to the rear of the swing jaw, via the cross beam 23, adjustment mechanism 42 and toggle plate 28. As a crushing force is generated, e.g. during cyclic movement of the swing jaw 16 in the direction of the fixed jaw 14, load from the crushing chamber 18 is transferred through the toggle plate 28 and adjustment mechanism 42 to the cross beam 22, against the action of the hydraulic cylinders 30. The hydraulic cylinders 28 hence provide a pre-loaded reaction to the applied load from the swing jaw to the cross beam 22.

As in GB238742, the cylinder pressure may be reduced, in order to relieve excess loads from the crushing chamber. However, the jaw crusher 10 is provided with a locking arrangement for selectively preventing substantial movement of the cross beam 22 against the action of the hydraulic cylinders 30. The locking arrangement gives the operator the option to maintain a pre-load in the cylinders 30 even in the event of high crushing pressures. The locking arrangement allows the jaw crusher to be used to crush difficult materials without using a pressure relief arrangement.

The locking arrangement includes two locking elements 56 configured to be manually inserted between the cylinders 30 and the rear face of the cross beam 22. More particularly, the locking elements 56 are intended to define a mechanical spacer between the cross beam 22 and the cylinder body 32, to prevent substantial rearward movement of the cross beam 22 against the action of the pistons 34.

In this embodiment, the locking elements 56 take the form of a U-shaped sleeve, e.g. having two parallel arms 58 joined by a cross-piece (not shown), in order to sit around at least a part of the circumference of the piston 34 with a clearance. Two loop handles 60 extend outwardly from each cross-piece to allow easy manipulation of the sleeves 56.

FIG. 1 shows the jaw crusher assembly 20 in an unlocked state, with the sleeves 56 removed from the assembly 10. In FIG. 2, the jaw crusher assembly 10 is in a locked state by the insertion of the sleeves 56, which serves to lock the position of the crossbeam (to prevent it moving rearwards against cylinder pressure.

The position of the crossbeam 22 remains substantially constant, even during the adjustment process, whereas the toggle plate 28 and the swing jaw 16 are moved as a result of movement of the wedges 44.

In alternative embodiments (not shown) the locking arrangement is configured so that the sleeves 56 are inserted automatically rather than manually.

The novel arrangement described herein provides a more adaptable jaw crusher, insofar as the locking arrangement gives the operator the option to maintain a pre-load in the cylinders even in the event of high crushing pressures. In GB2387342, the cylinder pressure is reduced, in order to relieve the excess load from the crushing chamber. This functionality may still be provided in a jaw crusher described herein. However, the locking arrangement allows the jaw crusher to be used to crush difficult materials without using a pressure relief arrangement. The locking member is movable between a first position, e.g. disengaged from the cross beam and cylinder body, where excess crushing loads (i.e. in excess of the pre-load pressure) are transmitted from the crossbeam to the hydraulic cylinders, and a second position, e.g. engaged between the cross beam and cylinder body, where excess crushing loads are carried by the side walls of the jaw crusher, by transfer through the cylinder body and associated end stops in the side wall aperture.

The adjustment mechanism is operable without the need to move the cross beam in a rearward direction and without needing to relieve the pressure applied through the cylinders.

The invention claimed is:

1. A jaw crusher having a fixed jaw and a swing jaw disposed between opposing side walls of the jaw crusher, wherein the swing jaw is movable relative to the fixed jaw for generating impelling forces to crush material present between the two jaws, wherein the jaw crusher includes a cross beam which extends between the opposing side walls and a toggle plate is provided between a rear face of the swing jaw and the cross beam, further wherein pressure cylinders are provided for applying a load to the cross beam, to provide a reaction to forces generated during movement of the swing jaw, and still further wherein the jaw crusher comprises a locking arrangement for selectively preventing substantial movement of the cross beam against the action of the pressure cylinders.

2. A jaw crusher according to claim 1 wherein the locking arrangement includes a locking member movable between a first position where crushing loads are transmitted from the crossbeam to the pressure cylinders and a second position where crushing loads are carried by the side walls of the jaw crusher.

3. A jaw crusher according to claim 1 wherein the locking member takes the form of a mechanical spacer for locking the cross beam against rearward movement in the event of excess loads being generated during movement of the swing jaw.

4. A jaw crusher according to claim 1 wherein the cross beam extends through apertures in the opposing side walls.

5. A jaw crusher according to claim 4 wherein each aperture includes a first end stop against which a first face of the cross beam is to be driven by the pressure cylinders.

6. A jaw crusher according to claim 4 wherein a pressure cylinder is mounted in each of said apertures for urging the cross beam in a first direction against a first end stop.

7. A jaw crusher according to claim 6 wherein the action of the cylinders is in line with the side walls.

8. A jaw crusher according to claim 4 wherein each pressure cylinder includes a cylinder body and a piston which is movable relative to the cylinder body, wherein the cylinder body is mounted within a respective side wall aperture against a second end stop.

9. A jaw crusher according to claim 8 wherein the locking arrangement includes a mechanical spacer to be positioned between a rear face of the cross beam and the cylinder body, wherein the spacer is configured for preventing substantial movement of the cross beam in the direction of said cylinder body.

10. A jaw crusher according to claim 3 or claim 9 wherein the spacer is configured to form a sleeve for at least a portion of the circumference of a piston forming part of the pressure cylinder.

11. A jaw crusher according to claim 1 further comprising an adjustment mechanism for the adjusting spacing between the jaws, wherein the adjustment mechanism is mounted in operative communication between the cross beam and the toggle plate, such that load is transmitted to the toggle plate via the adjustment mechanism during the application of load on the cross beam from the pressure cylinders.

12. A jaw crusher according to claim 11 wherein the adjustment mechanism comprises wedges slidable with respect to one another for increasing or decreasing the jaw spacing.

13. A jaw crusher according to claim 12 wherein the adjustment mechanism comprises at least one actuator configured to slide at least one of said wedges to increase or decrease the jaw spacing.

14. A jaw crusher according to claim 11 wherein the adjustment mechanism is operable without the need to move the cross beam in a rearward direction.

15. A jaw crusher according to claim 11 wherein the adjustment mechanism is operable without the need to relieve the pressure applied through the pressure cylinders.

16. A jaw crusher according to claim 1, wherein the locking arrangement includes a locking member movable between a first position and a second position;

wherein, when in the first position, the jaw crusher is configured to transmit crushing loads from the crossbeam to the pressure cylinders; and wherein, when in the second position, the jaw crusher is configured such that the side walls of the jaw crusher carry the crushing loads.

17. A jaw crusher according to claim 1, wherein the locking member is a mechanical spacer.

18. A jaw crusher according to claim 17, wherein the mechanical spacer is configured to lock the crossbeam against rearward movement in the event of excess loads being generated during movement of the swing jaw.

19. A jaw crusher according to claim 17, wherein the mechanical spacer comprises a U-shaped sleeve.

* * * * *